United States Patent [19]

Hubner

[11] 4,430,937

[45] Feb. 14, 1984

[54] FRONT REGISTER LAYS FOR SHEET-FED ROTARY PRINTING MACHINES

[75] Inventor: Heinz W. Hubner, Wurzburg, Fed. Rep. of Germany

[73] Assignee: Koenig & Bauer Aktiengesellschaft, Wurzburg, Fed. Rep. of Germany

[21] Appl. No.: 248,095

[22] Filed: Mar. 27, 1981

[30] Foreign Application Priority Data

Apr. 15, 1980 [DE] Fed. Rep. of Germany ..... 3014366

[51] Int. Cl.[3] ..... B41F 13/24; B65H 9/04

[52] U.S. Cl. ..... 101/232; 193/35 A; 198/368; 271/245

[58] Field of Search ..... 271/243, 245–247, 271/236–238, 250, 227; 198/368; 101/232–235, 407 R, 407 A; 193/35 A

[56] References Cited

U.S. PATENT DOCUMENTS 4,052,054 10/1977 Cardwell ..... 271/227
4,143,755 3/1979 Keller ..... 271/250 X

FOREIGN PATENT DOCUMENTS 537456 10/1931 Fed. Rep. of Germany .
1923625 11/1961 Fed. Rep. of Germany .
1230041 12/1966 Fed. Rep. of Germany .

*Primary Examiner*—A. J. Heinz
*Attorney, Agent, or Firm*—Jones, Tullar & Cooper

[57] ABSTRACT

Front register lays for a sheet-fed rotary printing press are disclosed. Each front register lay includes one or a plurality of front register lay fingers secured to a rotatable shaft. The sheets to be registered are conveyed along a feed metal sheet into engagement with a registering surface of each lay finger. This registering surface is disposed generally vertically and perpendicular to the direction of sheet travel during registry of the sheet against the registering surface of the lay fingers. After the sheet has been registered, the register lay fingers are rotated out of engagement with the sheet so that the sheet can proceed to the rotary printing press.

4 Claims, 3 Drawing Figures

FRONT REGISTER LAYS FOR SHEET-FED ROTARY PRINTING MACHINES

FIELD OF THE INVENTION

The present invention is directed to front register lays for a sheet-fed rotary printing machine. More particularly, the present invention is directed to front register lays which alternately enter into and out of a sheet path. Most specifically, the present invention is directed to front register lays which register sheets fed into a sheet-fed rotary printing press over a feed metal sheet. The front register lays are carried for revolution or reciprocatory oscillation on axes which may be parallel to the direction of travel of the sheets on the feed metal sheet or table. These register lays alternately enter into and out of the path of sheet travel on the feed metal sheet.

DESCRIPTION OF THE PRIOR ART

Front register lays for use with sheet-fed rotary printing machines have been known generally in the art for a substantial period of time. Conventionally, these lays swing down from a position above the feed metal sheet into the path along which the sheet to be registered is moving along the feed metal sheet. The sheet is registered when its leading edge contacts the front register lays, as may be seen in the German unexamined published application No. 1,923,625.

These prior front register lays must oscillate quite rapidly, especially in high speed printing presses and since they usually swing down from above, they are apt to continue to oscillate after the shaft on which they are carried has stopped. This after-oscillation reduces the accuracy of sheet registry and often contributes to vibrations in the feed metal sheet since the lays are apt to strike the sheet. Thus, precise sheet registering and quiet operation of the feed metal sheet are at least jeopardized and are often seriously disrupted by the operation of the known front register lays.

SUMMARY OF THE INVENTION

It is an object of the present invention to provide front register lays for a sheet-fed rotary printing machine.

Another object of the present invention is to provide front register lays which do not utilize oscillatory motion about swivel axes parallel to the leading edge of the sheet.

A further object of the present invention is to provide front register lays which move intermittently into and out of the path of sheet travel in a direction transverse to that of the direction of sheet travel.

As will be discussed in greater detail in the description of a preferred embodiment, the front register lays in accordance with the present invention are mounted for rotation on shafts which are disposed below and parallel to the direction of sheet travel. Thus the front register lays move into and out of the path of sheet travel transversely to the direction of sheet travel. The after-oscillation of the front register lays of the prior art devices is eliminated by the subject invention so that sheet register precision is greatly improved. Sheet infeed is also much quieter and smoother since the feed metal sheet is not excited by being struck by the front register lays, as has occurred in the prior art devices.

Compared to the oscillating front register lays of the prior art, the front register lays in accordance with the present invention permit a longer period of time to register the sheets at the front register lays thus affording higher precision in sheet registry. Furthermore, front register lay drive may easily be effected without the necessity of branching the drive from the sheet-fed rotary printing press drive. It is possible, if desired, to drive the front register lays of the present invention by means of electric controls through, for example, intermittent motors, and to selectively modify the sheet registering period.

BRIEF DESCRIPTION OF THE DRAWINGS

While the novel features of the front register lays for sheet-fed rotary printing machines in accordance with the present invention are set forth with particularity in the appended claims, a full and complete understanding of the invention may be had by referring to the description of a preferred embodiment as set forth hereinafter and as may be seen in the accompanying drawings in which:

DESCRIPTION OF THE PREFERRED EMBODIMENT

Figure 1:
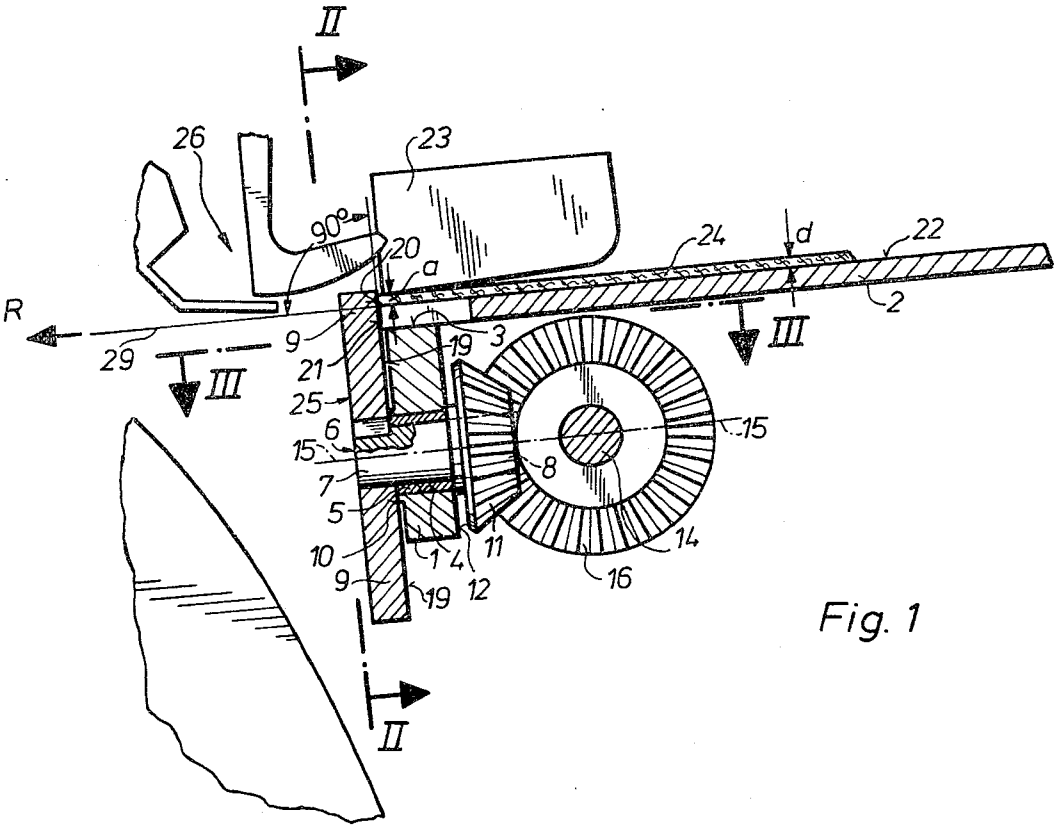
FIG. 1 is a schematic side elevation view, partly in section of the front register lay and its drive means in accordance with the present invention.

Turning initially to FIG. 1, there may be seen a front register lay for a sheet-fed rotary printing machine in accordance with the present invention. Between two spaced side frames (not shown) of the sheet-fed rotary printing machine, and on the inner surfaces of the side frames, an elongated horizontal support bar 1 is fastened by means of screws or the like (not shown) below a feed metal sheet 2. The feed metal sheet 2 is secured to a first face portion 3 of the support bar 1, and projects over the support bar 1 approximately 2 mm. A plurality of bearing boreholes 4 are positioned side by side in the support bar 1, with a bushing 5 of bearing metal being pressed into each of the bearing boreholes 4. Short shafts 6 are rotatably supported in these bearing bushes 5, the shafts 6 being disposed in such a way that an axis of rotation 15 of each of them extends in the sheet conveying direction "R" and preferably parallel to a sheet feeding surface 22 of the feed metal sheet 2. It would, however, also be practicable to dispose the axes of rotation 15 of the short shafts 6 in such a way that these axes 15 pass either through a Ist and IIIrd quadrant or through a IVth and IInd quadrant of a rectangular system of co-ordinates.

Figure 2:
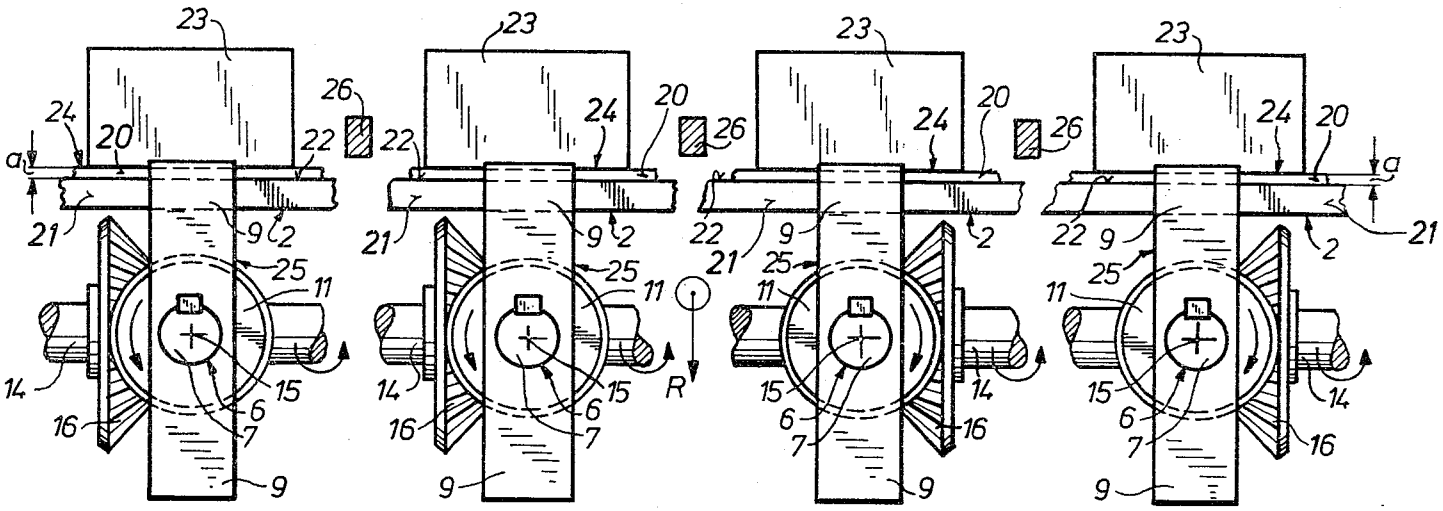
FIG. 2 is a front elevational view of the front register lays taken along line II—II of FIG. 1 with the supporting means and brackets removed for clarity.

A front register lay 25 comprised of either one or a plurality of front register lay fingers 9 is keyed onto a first end 7 of each shaft 6, and a toothed bevel gear 11 is keyed onto a second end 8 of each shaft 6. A plurality of front register lay fingers 9 may be attached to each shaft 6 in a radial array like a propeller, as is shown in FIGS. 1 and 2. The front register lay fingers 9 are disposed opposite a first lateral face portion 10 of the support bar 1, this lateral face 10 being directed in the sheet conveying direction "R" toward the sheet-fed rotary printing press. The front register lay fingers 9 are rotatable into a position close to a surface 21 of the feed metal sheet 2 so that their planar registering surfaces 19 are vertically positioned perpendicular to an imagined extension 29 of the sheet-feeding surface 22 and are turned towards the sheet feeder to just avoid contact with the forward surface 21 of the feed metal sheet 2.

Figure 3:
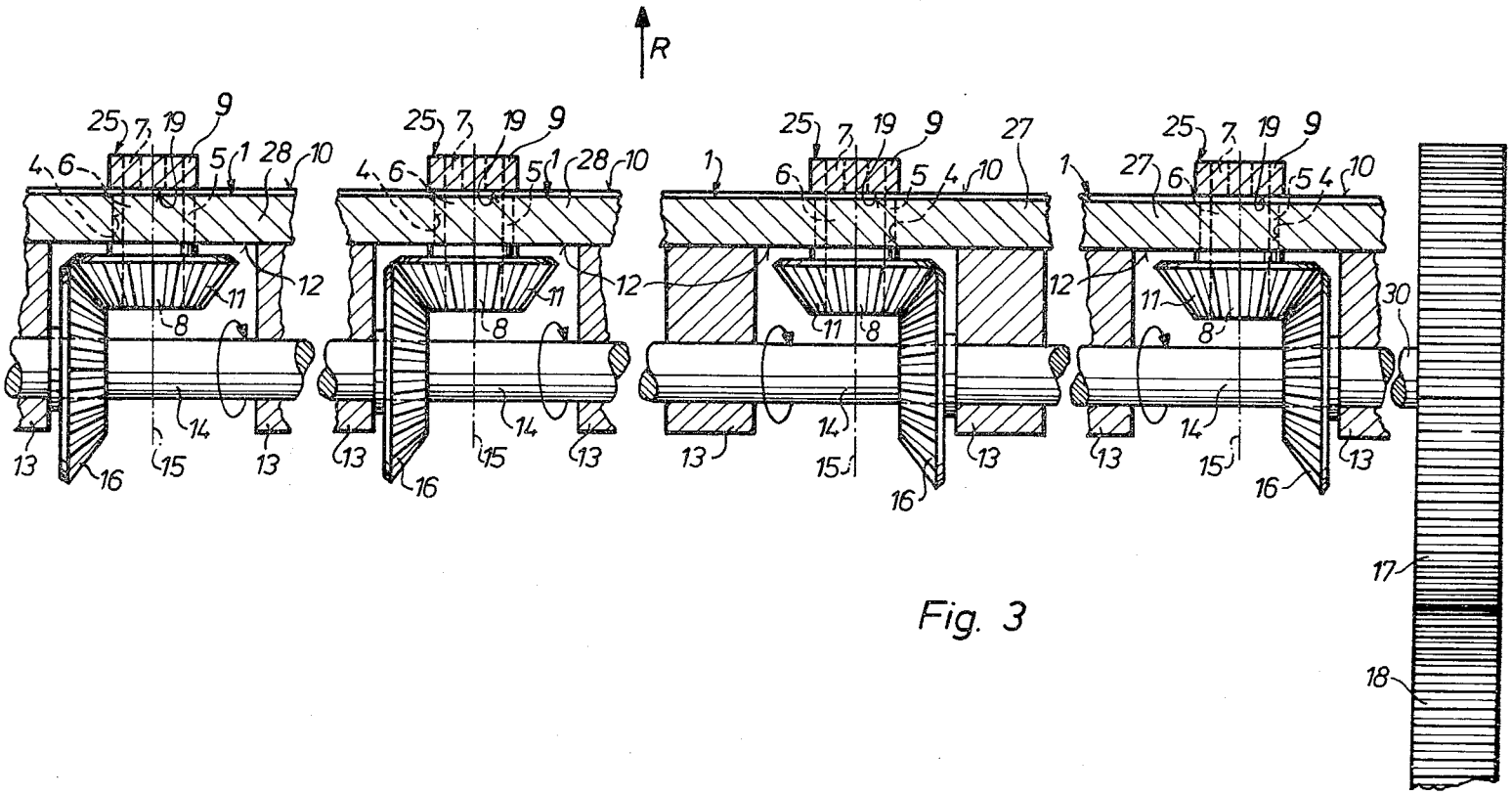
FIG. 3 is a top plan view, partly in section of the front register lays of the present invention taken along line III—III of FIG. 1.

A plurality of bearing brackets 13 support a drive shaft 14 as seen in FIG. 3. These brackets 13 are secured to a second lateral face 12 of the support bar 1. A plurality of toothed bevel gears 16 are secured onto a drive shaft 14, each bevel gear 16 meshing with one of the toothed bevel gear 11 which is co-ordinated to it, these toothed bevel gears 11 being supported by the support bar 1. A spur gear 17 is secured on an end 30 of the driving shaft 14 and meshes with a spur gear 18. Spur gear 18 may be driven, for example, through an intermittent motion gear (not shown) by the sheet-fed rotary printing press drive. Instead of the mechanical drive for the driving shaft 14 effected by means of a gear drive 17, 18 from the main drive, it would be possible to drive the driving shaft 14, for example, through an intermittent motor by means of a suitable control, whose nominal value transducer co-operates with a machine element, for example, with a so-called "single-tour shaft" of the sheet-fed rotary printing press. Such control would allow variations of the rotation of the front register lay fingers 9 to selectively modify the period of time in which the front register lay fingers 9 are in registering position.

The registering surfaces 19 of the front register lay fingers 9 move either continuously or not continuously on a circular path around the axis of rotation 15 of the short shafts 6, the front register lay fingers 9 being capable of being driven, as discussed previously, in such a way that they perform either a closed rotating motion, or only a reciprocating oscillating motion around the axes of rotation 15 of the short shafts 6.

A pressure block 23 is spaced a distance "a", this distance being capable of being altered, from the sheet-feeding surface 22 of the feed metal sheet 2. The distance "a" must always be capable of being adjusted to the thickness "d" of a sheet 24 to be registered at the front register lay fingers 9. Oscillating grippers 26, as seen in FIGS. 1 and 2, are disposed in a known manner and are capable of gripping the registered sheet 24 between spaced front register lay fingers 9. Other means, such as suction rollers or the like could be utilized to convey the sheet 24 to the sheet-fed rotary printing press.

As may be seen in FIG. 3, the motion of the front register lay fingers 9 is capable of being controlled in such a way that, for example, those front register lay fingers 9, which are supported in a right portion 27 of the support bar 1, as seen in the sheet feeding direction, rotate in a clockwise direction, and that those front register lay fingers 9 disposed in a left portion 28 of the support bar 1 rotate in a counter-clockwise direction.

As may be seen in FIG. 1, the registering surfaces 19 of the front register lay fingers 9 are disposed vertically upwardly in their registering position, so that the sheet 24 will be registered with its leading edge in contact with the registering surfaces 19 of the front register lay fingers 9. Conveyor belts or suction rollers (not shown) press the sheet 24 to be registered in a known manner with its leading edge 20 against the registering surfaces 19 of the front register lay fingers 9. As soon as the registering operation has been terminated, the front register lay fingers 9 begin rotating around their axes of rotation 15. As soon as the front register lay fingers 9 have left the sheet path, the grippers 26 can grip the registered sheet 24 and convey it into the sheet-fed rotary printing press.

While the front register lays of the present invention have hereinabove been described and discussed as being positioned below the feed metal sheet 2, it will be understood that the front register lays could be carried by a suitable support arrangement above the feed metal sheet 2.

While a full and complete description of a preferred embodiment of a front register lay for sheet-fed rotary printing machines has been set forth hereinabove, it will be obvious to one of ordinary skill in the art that a number of changes in, for example, the type of drive gears, the types of bearings, the number of lay fingers carried on each shaft, the type of sheet gripper fingers and the like could be made without departing from the true spirit and scope of the invention and that the invention is to be limited only by the following claims:

I claim:

1. A front register lay assembly for registering the leading edges of sheets to be fed over a feed metal sheet into a sheet-fed rotary printing machine, said front register lay assembly comprising:

a plurality of front register lay fingers;

means rotatably supporting said front register lay fingers for motion in an arc about an axis of rotation which is parallel to the sheet feed direction;

a registering surface on each said lay finger, each said registering surface being generally vertical and perpendicular to the direction of sheet feed when each said finger is in engagement with said sheet, each said registering surface contacting a leading edge of the sheet as the sheet is supported on the feed metal sheet; and, drive means to carry said front register lay fingers in said arc into and out of engagement with said leading edge of each of said sheets on said feed metal sheet whereby each of said sheets is registered and then released so that it can pass to the rotary printing machine.

2. Front register lays in accordance with claim 1 wherein each of said front register lay fingers is rigidly secured to a driven short shaft whose axis of rotation is parallel to the sheet conveying direction.

3. Front register lays in accordance with claim 2 wherein each of said short shafts carries a plurality of said front register lay fingers in a propellerlike array.

4. Front register lays in accordance with claim 1 wherein said drive means can produce either a rotary motion or an oscillatory motion of said front register lay fingers.

* * * * *